US006104421A

United States Patent [19]

Iga et al.

[11] Patent Number: 6,104,421

[45] Date of Patent: Aug. 15, 2000

[54] THERMAL TRANSFER TYPE COLOR PRINTER

[75] Inventors: Kaname Iga; Mitsuharu Endo, both of Shizuoka-ken; Hiroyuki Kushida, Odawara; Takashi Ichikawa, Shizuoka-ken, all of Japan

[73] Assignee: Toshiba Tec Kabushiki Kaisha, Tokyo, Japan

[21] Appl. No.: 09/392,090

[22] Filed: Sep. 8, 1999

Related U.S. Application Data

[62] Division of application No. 08/721,709, Sep. 27, 1996, Pat. No. 5,982,404.

[30] Foreign Application Priority Data

Sep. 29, 1995 [JP] Japan ..... 7-254224

[51] Int. Cl.[7] ..... B41J 2/325

[52] U.S. Cl. ..... 347/173

[58] Field of Search ..... 347/171, 172, 347/173, 175, 212, 213, 218

[56] References Cited

U.S. PATENT DOCUMENTS

| | | | |
|---|---|---|---|
| 4,695,305 | 9/1987 | Shiomi et al. | 65/395 |
| 5,070,342 | 12/1991 | Okumura et al. | 347/179 |
| 5,168,289 | 12/1992 | Katakabe et al. | 347/213 |
| 5,296,444 | 3/1994 | Saiki et al. | 503/277 |
| 5,821,974 | 10/1998 | Iga et al. | 347/211 |

FOREIGN PATENT DOCUMENTS

| | | |
|---|---|---|
| 0050481 | 10/1981 | European Pat. Off. . |
| 0 492 356 A1 | 7/1992 | European Pat. Off. . |

OTHER PUBLICATIONS

Patent Abstracts of Japan, vol. 018, No. 358 (M–1633), Jul. 5, 1994 (1994–07–06) and JP 06–092037 S (Sony Corp.; Others: 01), Apr. 5, 1994 (1994–04–05). * Abstract.

Patent Abstracts of Japan, vol. 007, No. 081 (M–205), Apr. 5, 1983 & JP 58 007393 A (Daini Seikosha KK), Jan. 17, 1983.

Patent Abstracts of Japan, vol. 010, No. 234 (M–507), Aug. 14, 1986 & JP 61 068270 A (Fuji Xerox Co., Ltd.), Apr. 8, 1986.

Patent Abstracts of Japan, vol. 014, No. 432 (M–1026), Sep. 17, 1990 & JP 02 171254 A (NEC Corp), Jul. 2, 1990.

Patent Abstracts of Japan, vol. 012, No. 416 (M–759), Nov. 4, 1988 & JP 63 154374 A (Fujitsu Ltd), Jun. 27, 1988.

*Primary Examiner*—N. Le
*Assistant Examiner*—Anh T. N. Vo
*Attorney, Agent, or Firm*—Frishauf, Holtz, Goodman, Langer & Chick, P.C.

[57] ABSTRACT

A thermal transfer type color printer of this invention has four ink ribbons sequentially arranged from a first order to a fourth order along a conveying direction of a printing medium, and four printing heads respectively arranged in accordance with the four ink ribbons. Each of the printing heads melts and transfers ink included in each of the ink ribbons to the printing medium by heating the ink ribbons while each of the ink ribbons comes in contact with the printing medium. While the printing medium is conveyed, the ink of each of the ink ribbons is transferred to the printing medium so that a color image is formed. In this color printer, a melting viscosity of the ink of an ink ribbon used at a later stage is set to be lower than that used at a previous stage.

68 Claims, 8 Drawing Sheets

| INK | | | EVALUATION RESULTS | |
|---|---|---|---|---|
| | | | TRANSFER PROBABILITY | SHARP |
| M1 | — | — | A | A |
| | C1 | — | B | B |
| | | Y1 | C | C |
| | | Y2 | C | C |
| | | Y3 | C | C |
| | C2 | — | A | A |
| | | Y1 | C | C |
| | | Y2 | C | C |
| | | Y3 | B | B |
| | C3 | — | AA | AA |
| | | Y1 | C | C |
| | | Y2 | C | C |
| | | Y3 | B | B |
| | — | Y1 | B | B |
| | | Y2 | A | A |
| | | Y3 | AA | AA |
| — | C1 | — | A | A |
| | | Y1 | B | B |
| | | Y2 | A | A |
| | | Y3 | AA | AA |
| | C2 | — | AA | AA |
| | | Y1 | C | C |
| | | Y2 | B | B |
| | | Y3 | A | A |
| | C3 | — | AA | AA |
| | | Y1 | C | C |
| | | Y2 | C | C |
| | | Y3 | B | B |
| | — | Y1 | A | A |
| | | Y2 | AA | AA |
| | | Y3 | AA | AA |

FIG. 11

| INK | | | EVALUATION RESULTS | |
|---|---|---|---|---|
| | | | TRANSFER PROBABILITY | SHARP |
| M2 | — | — | AA | AA |
| | C1 | — | C | C |
| | | Y1 | C | C |
| | | Y2 | C | C |
| | | Y3 | C | C |
| | C2 | — | B | B |
| | | Y1 | C | C |
| | | Y2 | C | C |
| | | Y3 | C | C |
| | C3 | — | A | A |
| | | Y1 | C | C |
| | | Y2 | C | C |
| | | Y3 | C | C |
| | — | Y1 | C | C |
| | | Y2 | B | B |
| | | Y3 | A | A |

FIG. 12

| INK | | | EVALUATION RESULTS | |
|---|---|---|---|---|
| | | | TRANSFER PROBABILITY | SHARP |
| M3 | — | — | AA | AA |
| | C1 | — | C | C |
| | | Y1 | C | C |
| | | Y2 | C | C |
| | | Y3 | C | C |
| | C2 | — | C | C |
| | | Y1 | C | C |
| | | Y2 | C | C |
| | | Y3 | C | C |
| | C3 | — | B | B |
| | | Y1 | C | C |
| | | Y2 | C | C |
| | | Y3 | C | C |
| | — | Y1 | C | C |
| | | Y2 | C | C |
| | | Y3 | B | B |

FIG. 13

| INK NO. | SEPARATING LAYER g/m2 | INK LAYER g/m2 | LAYER THICKNESS RATIO | EVALUATION RESULTS | |
|---|---|---|---|---|---|
| | | | | TRANSFER PROBABILITY | SHARP |
| M4 | 1.4 | 1.6 | 0.875 | B | B |
| M5 | 1.5 | 1.5 | 1 | B | B |
| M6 | 1.55 | 1.4 | 1.10714 | A | A |
| M7 | 1.6 | 1.3 | 1.23077 | A | A |
| M8 | 1.7 | 1.3 | 1.30769 | AA | AA |
| M9 | 1.8 | 1.3 | 1.38462 | AA | AA |
| M10 | 1.8 | 1.2 | 1.5 | AA | AA |

FIG. 14

| INK NO. | SEPARATING LAYER g/m2 | INK LAYER g/m2 | LAYER THICKNESS RATIO | EVALUATION RESULTS | |
|---|---|---|---|---|---|
| | | | | TRANSFER PROBABILITY | SHARP |
| C4 | 1.4 | 1.6 | 0.875 | B | B |
| C5 | 1.5 | 1.5 | 1 | B | B |
| C6 | 1.55 | 1.4 | 1.10714 | A | A |
| C7 | 1.6 | 1.3 | 1.23077 | A | A |
| C8 | 1.7 | 1.3 | 1.30769 | AA | AA |
| C9 | 1.8 | 1.3 | 1.38462 | AA | AA |
| C10 | 1.8 | 1.2 | 1.5 | AA | AA |

FIG. 15

| INK NO. | SEPARATING LAYER g/m2 | INK LAYER g/m2 | LAYER THICKNESS RATIO | EVALUATION RESULTS | |
|---|---|---|---|---|---|
| | | | | TRANSFER PROBABILITY | SHARP |
| Y4 | 1.4 | 1.6 | 0.875 | B | B |
| Y5 | 1.5 | 1.5 | 1 | B | B |
| Y6 | 1.55 | 1.4 | 1.10714 | A | A |
| Y7 | 1.6 | 1.3 | 1.23077 | A | A |
| Y8 | 1.7 | 1.3 | 1.30769 | AA | AA |
| Y9 | 1.8 | 1.3 | 1.38462 | AA | AA |
| Y10 | 1.8 | 1.2 | 1.5 | AA | AA |

FIG. 16

| FIRST INK COLOR | SECOND INK COLOR | EVALUATION RESULTS | |
|---|---|---|---|
| | | TRANSFER PROBABILITY | SHARP |
| M6 | C4 | C | C |
| | C5 | C | C |
| | C6 | C | C |
| | C7 | B | B |
| | C8 | B | B |
| | C9 | A | A |
| | C10 | AA | AA |

FIG. 17

| FIRST INK COLOR | SECOND INK COLOR | THIRD INK COLOR | EVALUATION RESULTS | |
|---|---|---|---|---|
| | | | TRANSFER PROBABILITY | SHARP |
| M6 | C7 | Y4 | C | C |
| | | Y5 | C | C |
| | | Y6 | C | C |
| | | Y7 | B | B |
| | | Y8 | B | B |
| | | Y9 | A | A |
| | | Y10 | AA | AA |

FIG. 18

THERMAL TRANSFER TYPE COLOR PRINTER

This is a division of application Ser. No. 08/721,709 filed Sep. 27, 1996, now U.S. Pat. No. 5,982,404.

BACKGROUND OF THE INVENTION

1. Field of the Invention

This invention relates to a thermal transfer type color printer in which plural ink ribbons having different color components are arranged and interposed between a printing head and a printing medium and the printing head heats the ink ribbons so that ink of each of the ink ribbons is melted and transferred to the printing medium and a color image is formed.

2. Description of the Related Art

FIG. 1 schematically shows a conventional thermal transfer type color printer disclosed in Jap. Pat. Appln. KOKAI Publication No. 59-188452.

As shown in FIG. 1, this color printer has print units 101, 102, 103 and 104 for yellow (Y), magenta (M), cyan (C) and black (K) sequentially arranged on a conveying path 105 for conveying a paper sheet 106.

For example, the print unit 101 for yellow has a thermal line head 101-1, an ink ribbon mechanism and a platen roller 101-4 for transfer. The ink ribbon mechanism has a supplying roller 101-3A and a winding roller 101-3B as a pair. The supplying roller 101-3A supplies a yellow ink ribbon 101-2 including yellow ink onto a heating face of a heating resistor forming the thermal line head 101-1.

The other print units 102 to 104 also have a structure similar to that of the yellow print unit except that the ink ribbons respectively include magenta, cyan and black ink. Accordingly, a more detailed description of the print units 102 to 104 is omitted here.

The paper sheet 106 is conveyed from the yellow print unit 101 to the black print unit 104 along a conveying path 105 by a first feed roller pair 107 and a second feed roller pair 108. In each of the print units 101 to 104, the paper sheet 106 passes through portions between the respective ink ribbons 101-2 to 104-2 and the respective platen rollers 101-4 to 104-4.

At a printing time, while the paper sheet 106 is conveyed from the yellow print unit 101 to the black print unit 104, a yellow image is first printed on the paper sheet 106 by the yellow print unit 101. When this printed portion reaches the heating face of each of the thermal line heads 102-1 to 104-1 of the other respective print units 102 to 104, respective color images are synchronously overlapped and printed sequentially on the paper sheet. At this time, the plural inks are overlapped and mixed with each other so that an image having a predetermined hue is printed.

Thus, in the thermal transfer type color recording method of a 3 to 4 head system having one thermal line head every one color, an image can be printed at high speed since no paper sheet 106 is repeatedly reciprocated every print of one color as in one head system.

In the thermal transfer type color printer, when a paper sheet having a low surface smoothness, i.e., a paper sheet having a rough surface is used, an amount of ink permeating recessed portions of this paper sheet is insufficient so that it is difficult to transfer the ink to the paper sheet and there is a fear of generation of a whitish extracting state in which no characters are printed. Therefore, there is a problem of a reduction in printing quality.

Two methods are considered to solve this problem.

A first method is a method described in NIKKEI ELECTRONICS 1995. 7. 17, No. 640, p.99. In accordance with this description, the first method uses a serial type thermal head constructed such that ink is printed onto a paper sheet while a cartridge having a thermal head is moved in a main scanning direction perpendicular to a conveying direction of the paper sheet. Ink having a high melting viscosity and including resin is used and heated and melted. An ink ribbon and a recording medium are separated from each other before this ink is solidified. Thus, as shown in FIG. 2, the ink 113 is transferred to a recessed portion 112 on a surface 111 of the recording medium in a bridging shape.

As shown in FIG. 3, the used ink ribbon has a separating layer 122 and a resin-including ink layer 123. The separating layer 122 is formed on a base film layer 121 and has 1.3 $\mu$m in thickness. The resin-including ink layer 123 is formed on this separating layer 122 and has 1.5 $\mu$m in thickness. This separating layer 122 is formed by a material having a low melting viscosity and is completely melted at a softening temperature of the ink layer 123 so that the separating layer 122 has almost no adhesive force. Therefore, the separating layer 122 acts as a layer for easily separating the ink layer 123 from the base film layer 121. A back coat layer 124 is formed outside the above base film layer 121.

The resin-including ink is formed by dispersing a pigment to thermoplastic resin and can hold a high viscosity even at a temperature such as about 100° C. In contrast to this, wax-including ink including wax, etc. has a low viscosity so that the wax-including ink is almost liquefied at a temperature such as about 100° C.

A second method is a method in which ink easily permeates a paper sheet until a recessed portion thereof by using the wax-including ink of a low melting viscosity.

However, in the conventional thermal transfer type color printer having the plural print units continuously arranged as shown in FIG. 1, it is necessary to raise a heating resistor of the thermal line head to a high temperature for a very short time and stably melt ink in a wide range and transfer this ink to the paper sheet when a color print is made at high speed. Therefore, in the thermal transfer type color printer of the conventional 3 to 4 head system, for example, a printing condition is basically different from that in the printer of a 1 head system using a serial type thermal head so that it is difficult to adopt the above-mentioned two methods Namely, when the above-mentioned first method is applied to the thermal transfer type color printer of the 3 to 4 head system, there is a problem of generation of a phenomenon of leaving ink on the base film at a transfer time, etc. For example, the printer using the serial type head uses ink ribbons of four colors or four ink cartridges including a separating layer having a low melting viscosity and a resin-including ink layer having a high melting viscosity. An entire paper sheet is first printed in yellow (Y) and is next repeatedly printed four times in a sequential order of magenta (M), cyan (C) and black (K) so that a color print is realized by overlapping the colors. When the colors are overlapped, ink as a base previously printed is already solidified. The wax-including ribbon used in the second method shows characteristics in which viscosity is suddenly reduced at a certain temperature. However, the resin-including ink shows characteristics in which viscosity is gradually reduced with a rise in temperature. Accordingly, the printer using the conventional serial type head has a sufficient time margin while the colors are overlapped. Therefore, the ink as a base previously printed is sufficiently cooled and solidified.

In contrast to this, in the printer of a 3 to 4 head system as shown in FIG. 1, the paper sheet sequentially passes through the plural thermal units continuously arranged at high speed. In this passage, a color overlapping interval of each of the thermal units is short so that no ink of a color as a base previously printed is cooled. Accordingly, the next ink is overlapped with the previously printed ink in a state in which no previously printed ink is sufficiently solidified.

Similar to the case of directly transferring ink onto the paper sheet, when the next color ink is simply transferred onto the ink not sufficiently solidified, there is a fear of generation of a phenomenon of leaving the ink on the base film when an ink ribbon is separated from the paper sheet. In the case of a color thermal transfer record, color overlapping is one of the most difficult processes. In particular, a surface state of a printed object as a base exerts a great influence on a printing quality of the printed object so that a recording method not influenced by the base is desirable.

Further, a load applied to the ink ribbon by a thermal head in the printer using the serial type head is greatly different from that in the printer of the 3 to 4 head system.

Namely, in the printer using the serial type head, a large load can be applied to the ink ribbon in comparison with the thermal line head. Therefore, the ink ribbon can sufficiently come in press contact with the paper sheet by this load so that the resin-including ink of a high melting viscosity can be transferred to the paper sheet.

However, when the large load is applied in the case of the thermal line head, wrinkles are caused in the paper sheet and the ink ribbon and a color shift between the respective units is increased. Therefore, only a small load is applied to the ink ribbon in comparison with the serial type head. When no ink ribbon can sufficiently come in press contact with the paper sheet, an untransfer portion of ink onto the paper sheet is caused when the resin-including ink of a high melting viscosity is used. Accordingly, there is a fear of generation of a whitish extracting state wherein no characters are printed on the paper sheet.

In particular, when a third color is printed in the case of a color record, it is necessary to transfer ink for a short time. However, there are irregularities on the surface of a recording medium and there are also irregularities of thicknesses of two color inks previously printed. Accordingly, the end portions of a transferred ink image are not sharply printed and ink is insufficiently fixed onto the paper sheet so that there is a reduction in printing quality.

Further, when the second method is applied to the printer of the 3 to 4 head system and characters are printed at high speed, the amount of ink permeating recessed portions of the recording medium is insufficient even when the ink is melted. Accordingly, the whitish extracting state can not be prevented. A sufficient permeating amount of the ink permeating the recessed portions of the recording medium on its surface is required to prevent the whitish extraction in this second method. Therefore, the second method is effective in a monochromatic printer, but there is a fear of insufficiency of the permeating amount of ink in second and third overlapping prints in a high speed print in the color printer.

As mentioned above, in the thermal transfer type color printer using the conventional thermal line head, it is difficult to print a color image having a high quality at high speed due to the influences of a surface state of the paper sheet and a transfer state of ink previously printed.

SUMMARY OF THE INVENTION

An object of this invention is to provide a thermal transfer type color printer in which a color image having a high quality can be printed at high speed irrespective of the influences of a surface state of a paper sheet and a transfer state of ink previously printed.

A thermal transfer type color printer in which a color image is formed by transferring ink from an ink ribbon to a printing medium while the printing medium is being conveyed and which comprises: first to N-th ink ribbons arranged sequentially in the order mentioned, in a direction in which the printing medium is conveyed, and having ink layers of different colors, respectively; and first to N-th printing heads provided in association with the first to N-th ink ribbons, respectively, for melting the ink layers by heating the first to N-th ink ribbons and transferring molten inks of different colors from the first to N-th ink ribbons to the printing medium as the first to N-th ink ribbons come into contact with the printing medium, wherein the ink layer of the n-th ink ribbon has a lower melt viscosity than the ink layer of the (n−1)th ink ribbon, where $2 \leqq n \leqq N$.

In accordance with the thermal transfer type color printer of this invention, the melting viscosity of ink of the ink ribbon used in the n-th order is set to be lower than that of the ink ribbon used in the (n−1)-th order. Therefore, the ink is easily separated from the n-th ink ribbon even when the ink from the n-th ink ribbon is melted and transferred onto the ink melted and transferred to the printing medium from the (n−1)-th ink ribbon. Therefore, the ink is moderately transferred reliably onto the printing medium from the n-th ink ribbon. Accordingly, a color image having a high quality can be formed irrespective of a surface state of a paper sheet and a transfer state of the ink previously printed while a high printing speed is maintained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 11 to 13 are views showing evaluation results of an image quality when inks of M1, M2, M3, C1, C2, C3, Y1, Y2 and Y3 are variously combined with each other and are printed;

FIG. 14 is a view showing evaluation results of an image quality when magenta ink is monochromatically printed in different conditions of a layer thickness ratio;

FIG. 15 is a view showing evaluation results of an image quality when cyan ink is monochromatically printed in different conditions of a layer thickness ratio;

FIG. 16 is a view showing evaluation results of an image quality when yellow ink is monochromatically printed in different conditions of a layer thickness ratio;

FIG. 17 is a view showing evaluation results of a printing quality when inks of two colors are overlapped and printed; and FIG. 18 is a view showing evaluation results of a printing quality when inks of three colors are overlapped and printed.

DETAILED DESCRIPTION OF THE PREFERRED EMBODIMENTS

The embodiment forms of this invention will next be described with reference to the drawings.

Figure 1:
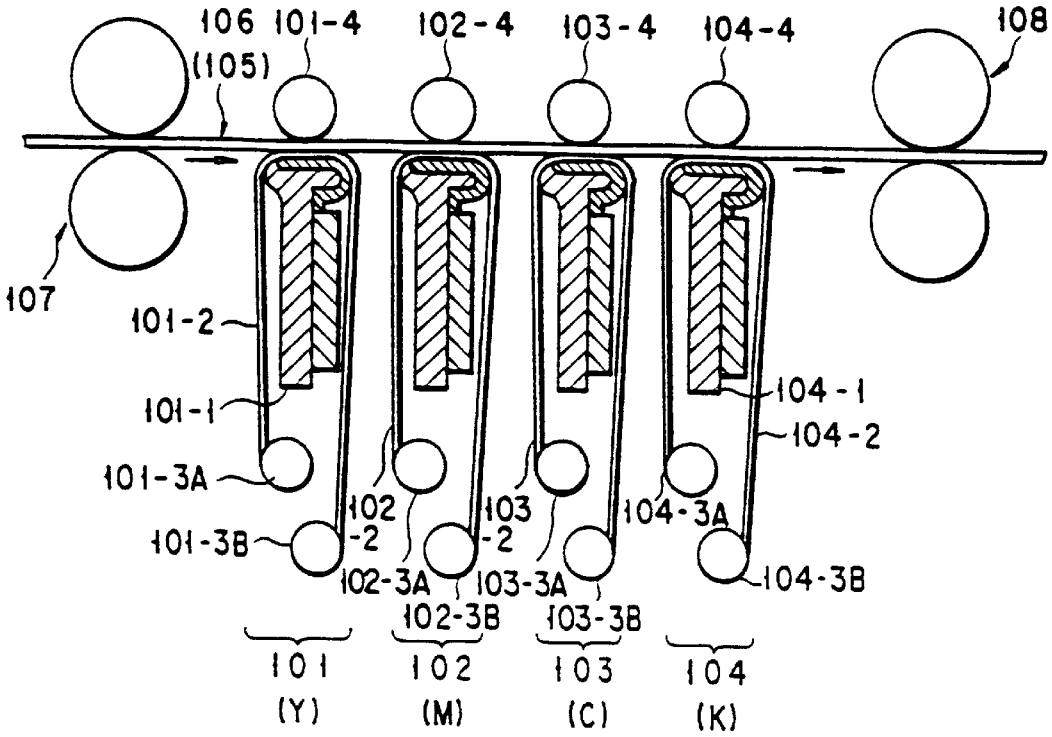
FIG. 1 (PRIOR ART)
FIG. 1 is a view schematically showing the construction of a main portion of a conventional thermal transfer type color printer having four thermal line heads.
Figure 2:
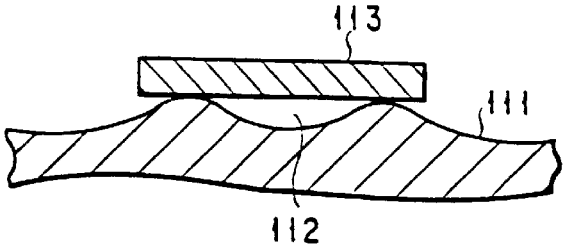
FIG. 2 (PRIOR ART)
FIG. 2 is a view for explaining one example of a conventional method in which ink is printed on a recessed portion of a recording medium.
Figure 3:
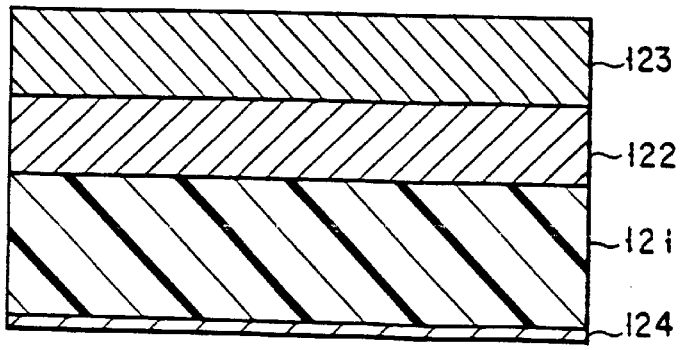
FIG. 3 (PRIOR ART)
FIG. 3 is a cross-sectional view showing the construction of a main portion of an ink ribbon conventionally used.
Figure 4:
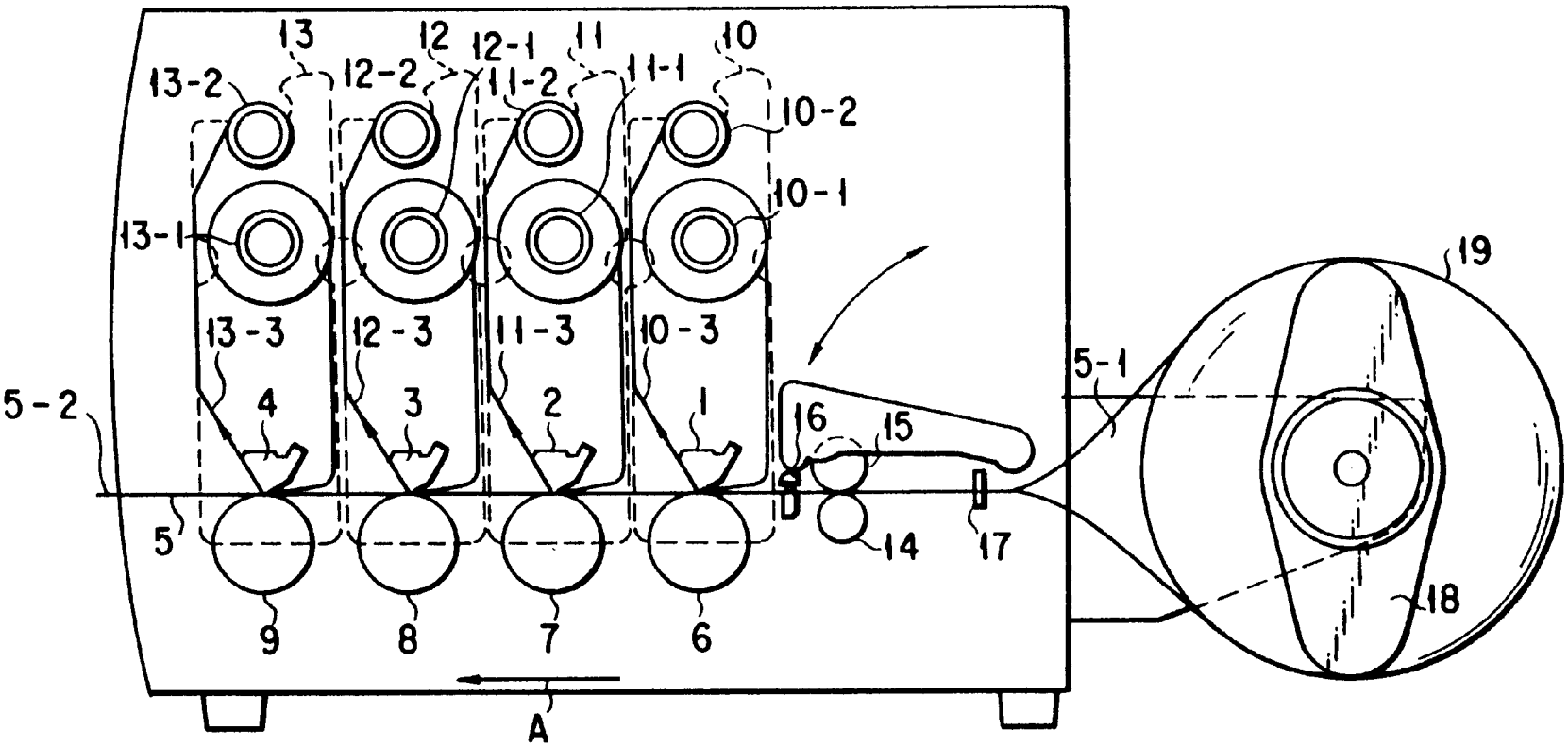
FIG. 4 is a view schematically showing the construction of a main portion of a thermal transfer type color printer in accordance with this invention.

FIG. 4 is a cross-sectional view schematically showing the construction of a main portion of a thermal transfer type color printer (hereinafter, called a color printer) in accordance with this invention. In this color printer, a color image is formed by overlapping and printing images of four colors composed of black (hereinafter, called "K"), magenta (hereinafter, called "M"), cyan (hereinafter, called "C") and yellow (hereinafter, called "Y").

A thermal head 1 for K, a thermal head 2 for M, a thermal head 3 for C and a thermal head 4 for Y are sequentially arranged along a conveying direction of a conveying path 5 for conveying a paper sheet 19 as a printing medium, i.e., a sub-scanning direction of an arrow A in FIG. 4. Each of the thermal heads 1 to 4 is an end face thermal line head in which plural heating resistors are arranged in one line on an end face of a rectangular parallelepiped having 4 inches in length. Resolution of the thermal head is set to 12 dot/mm and a load of the thermal head per unit length in a main scanning direction is set to 0.4 kg/cm. The distance between these thermal heads is set to 100 mm.

A platen roller 6 for K is arranged in a position opposed to the thermal head 1 for K. Further, a ribbon magazine 10 is detachably arranged in the color printer.

The ribbon magazine 10 has a feed roller 10-1 and a winding roller 10-2. An unused ink ribbon 10-3 for K including black ink is wound around the feed roller 10-1. A used ink ribbon is wound around the winding roller 10-2.

An ink ribbon 10-3 for K is supplied from this ribbon magazine 10 to the thermal head 1.

Similarly, a platen roller 7 for M is arranged in a position opposed to the thermal head 2 for M. Further, a ribbon magazine 11 having a feed roller 11-1 and a winding roller 11-2 is detachably arranged in the color printer. An unused ink ribbon 11-3 for M including magenta ink is wound around the feed roller 11-1. A used ink ribbon is wound around the winding roller 11-2. An ink ribbon 11-3 for M is supplied from this ribbon magazine 11 to the thermal head 2.

Similarly, a platen roller 8 for C is arranged in a position opposed to the thermal head 3 for C. Further, a ribbon magazine 12 having a feed roller 12-1 and a winding roller 12-2 is detachably arranged in the color printer. An unused ink ribbon 12-3 for C including cyan ink is wound around the feed roller 12-1. A used ink ribbon is wound around the winding roller 12-2. An ink ribbon 12-3 for C is supplied from this ribbon magazine 12 to the thermal head 3.

Similarly, a platen roller 9 for Y is arranged in a position opposed to the thermal head 4 for Y. Further, a ribbon magazine 13 having a feed roller 13-1 and a winding roller 13-2 is detachably arranged in the color printer. An unused ink ribbon 13-3 for Y including yellow ink is wound around the feed roller 13-1. A used ink ribbon is wound around the winding roller 13-2. An ink ribbon 13-3 for Y is supplied from this ribbon magazine 13 to the thermal head 4.

Each of the thermal heads 1 to 4 is set such that a line pressure of 0.3 to 0.6 kg/cm is applied to the ink ribbon in a direction of each of the platen rollers 6 to 9.

A roller 14 for conveying paper and an auxiliary roller 15 are arranged on a paper sheet supplying side of the conveying path 5 in an arranging position of the thermal head 1 for Y. The roller 14 controls a conveying speed of the paper sheet. The auxiliary roller 15 is opposed to this roller 14.

A sensor section 16 is arranged on the conveying path 5 between the roller 14 for conveying paper and the thermal head 1 for K. The sensor section 16 has a gap sensor for detecting the gap between labels of the paper sheet and a marker sensor for detecting a mark printed on the paper sheet. A paper end sensor 17 is arranged in the vicinity of a paper sheet supplying port 5-1 on the conveying path 5 on a further paper sheet supplying side of the roller 14 for conveying paper. The paper end sensor 17 has an optical transmission type sensor for detecting a terminal end of the paper sheet.

A paper holder 18 is arranged outside the paper sheet supplying port 5-1 of the conveying path 5. The paper sheet 19 having an elongated shape is wound around this paper holder 18 and is set. A paper sheet discharging port 5-2 for discharging a printed paper sheet is formed on a side opposed to the paper sheet supplying port 5-1 of the conveying path 5.

In the color printer having such a structure, the ink ribbons supplied from the respective ribbon magazines 10 to 13 and the paper sheet 19 supplied from the paper holder 18 are conveyed approximately at an equal speed between the respective thermal heads 1 to 4 and the respective platen rollers 6 to 9. Desirable images of black, magenta, cyan and yellow are respectively overlapped and formed sequentially so that a color image is formed on the paper sheet 19.

Next, a structure of each of the ink ribbons used in this color printer will be explained.

Figure 5:
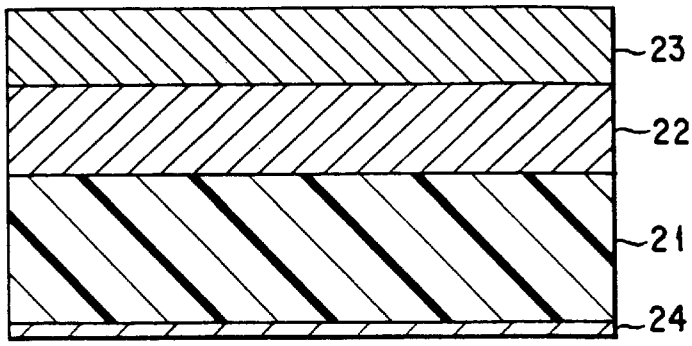
FIG. 5 is a cross-sectional view showing one example of the construction of a main portion of an ink ribbon used in the color printer shown in FIG. 4.

FIG. 5 is a cross-sectional view showing the construction of a main portion of an ink ribbon.

The ink ribbon has a base film layer 21, a separating layer 22, an ink layer 23 and a back coat layer 24. The separating layer 22 is formed as an intermediate layer on the base film layer 21. The ink layer 23 is formed on this separating layer 22 as a surface layer including ink of a predetermined color component. The back coat layer 24 is formed on a lower face of the above base film layer 21, i.e., a side face thereof opposed to a forming face of the separating layer 22.

The base film layer 21 is formed by polyethylene terephthalate, cellophane polycarbonate, polyvinyl chloride, polyimide, etc.

This base film layer 21 has about 1 to 15 $\mu$m in thickness and preferably has a thickness from 1 to 6 $\mu$m in consideration of mechanical strength, transfer property of ink, etc.

The separating layer 22 has a viscosity less than $1\times10^4$ cps at 100° C. and is mainly formed by a wax material. This separating layer 22 is independently formed by haze wax, beeswax, carnauba wax, microcrystalline wax, paraffin wax, rice wax, polyethylene-including wax, polypropylene-including wax, wax oxide, etc., or is formed by mixing these waxes with each other. A melting point of this separating layer 22 preferably ranges from 60° C. to 90° C. This melting point is measured by a differential scanning calorimeter and corresponds to a central temperature at a heat absorption peak.

The ink layer 23 has a viscosity equal to or greater than $1\times10^4$ cps and equal to or smaller than $2\times10^8$ cps at 100° C. and is formed by resin and a coloring agent as principal components.

The resin used in this ink layer 23 is independently constructed by petroleum resin, polyethylene, polyvinyl chloride, ethylene-polyvinyl acetate copolymer, polyester resin, polyamide resin, acrylic resin, polystyrene, etc., or is constructed by mixing these materials with each other.

A melting point of this ink layer 23 is desirably set to be higher than that of the separating layer 22 by 5 to 40° C. When resin having a high molecular amount is used, ink is not solidified at once, but is gradually solidified when the ink is rapidly cooled. This phenomenon is a supercooling phenomenon. Accordingly, when characters are printed at high speed, it is considered that ink printed just before, i.e., a basic ink at a color overlapping time is not sufficiently solidified.

A coloring agent as cyan used in the ink layer 23 uses one or two kinds or more of pigments such as phthalocyanine blue, Victoria blue lake fast sky blue, etc. and dyes such as Victoria blue, etc. A coloring agent for magenta uses one or two kinds or more of pigments such as rhodamine lake B, rhodamine lake T, rhodamine lake Y, permanent red 4R, brilliant fast scarlet, brilliant carmine BS, permanent red F5R, etc. and dyes such as rhodamine, etc. A coloring agent for yellow uses one or two kinds or more of pigments such as benzine yellow G, benzine yellow GR, Hansa yellow G, permanent yellow NCG, etc. and dyes such as auramine, etc.

A thickness of the separating layer 22, i.e., a coating amount of the separating layer 22 per unit area is greater than that of the ink layer 23. The separating layer 22 has a melting viscosity lower than that of the ink layer 23. Therefore, when the separating layer 22 is melted at a printing time, the separating layer 22 and ink of the ink layer 23 attain a compatible state in the vicinity of a boundary thereof. In this compatible state, the separating layer 22 and the ink of the ink layer 23 are mutually melted and mixed with each other and function such that the melting viscosity of the ink is reduced by this compatibility. Therefore, this separating layer 22 is formed to be thicker than the ink layer 23 so as to adjust the melting viscosity of the ink as well as separation as in the conventional separating layer 122.

Materials of the separating layer 22 and the ink layer 23 approximately have the same density of about 1 g/cm$^3$.

A ratio of the thicknesses of the separating layer 22 and the ink layer 23 in each of the ink ribbons is set such that a ratio of the thickness of the separating layer 22 is increased as a sequential order of the overlapping print is later. For example, in the example of the color printer shown in FIG. 4, the ratio of the separating layer 22 to the ink layer 23 in the magenta ink ribbon 11-3 is set to be higher than that in the black ink ribbon 10-3. Accordingly, the melting viscosity of ink printed at a later stage is lower than that printed at a previous stage.

Further, the separating layer 22 in an ink ribbon at the later stage may be simply set to be thicker than that in an ink ribbon at the previous stage. Otherwise, the thickness of the ink layer 23 in an ink ribbon at the later stage may be set to be thinner than that in an ink ribbon at the previous stage. The melting viscosity of ink printed at the later stage can be set to be lower than that printed at the previous stage as mentioned above even when the ink ribbons are formed in this way.

When the ink ribbons are manufactured, the boundary of the separating layer 22 and the ink layer 23 is not formed by clearly separating these layers from each other, but a mutual compatible state is attained near this boundary. However, in this invention, a desirable melting viscosity of ink is realized by making the materials of the separating layer 22 and the ink layer 23 compatible at a printing stage of ink on a printing medium. Therefore, there is no problem about existence of the boundary in the above compatible state.

Figure 6:
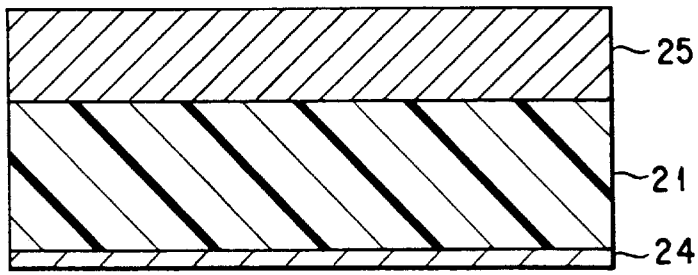
FIG. 6 is a cross-sectional view showing another example of the construction of the main portion of the ink ribbon used in the color printer shown in FIG. 4.

As shown in FIG. 6, an ink mixing layer 25 as a single layer may be formed by mixing a first material forming the separating layer including a wax material and a second material forming the ink layer including resin at the manufacturing time of an ink ribbon. A mixing ratio of the first and second materials in this ink mixing layer 25 is set such that a ratio of the first material is large. Further, the ratio of the first material of the ink mixing layer included in an ink ribbon at the later stage is set to be larger than that at the previous stage such that the melting viscosity of ink printed at the later stage is lower than that printed at the previous stage.

Further, the melting point of ink of each ink ribbon may be set to be lower in a later order in the overlapping print.

With respect to the back coat layer 24, the lower face of the base film layer 21 is coated with a coating liquid for the back coat layer and is then dried so that the back coat layer 24 is formed. This back coat layer 24 may be formed by the same material as the conventional material so as to improve smoothness of a thermal head and prevent sticking.

Figure 7:
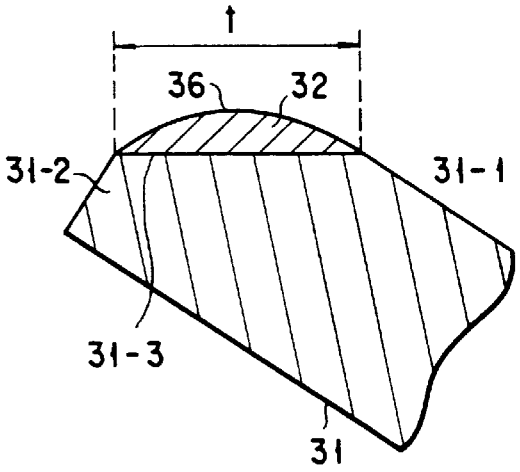
FIG. 7 is a cross-sectional view schematically showing an end tip portion of a thermal line head arranged in the color printer shown in FIG. 4.
Figure 8:
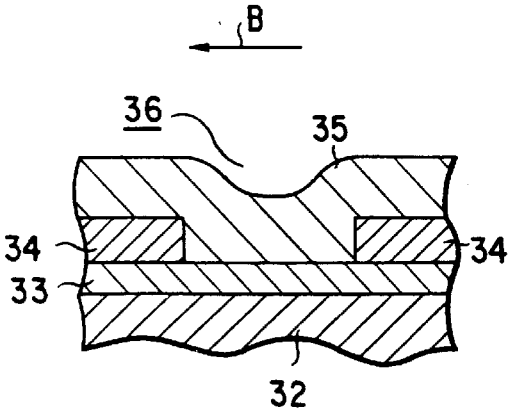
FIG. 8 is a cross-sectional view showing the construction of a main portion of a heating element formed in one portion of the end tip portion of the thermal line head shown in FIG. 7.

FIG. 7 is a cross-sectional view showing the construction of a main portion of an end tip portion of each of the thermal line heads 1 to 4. FIG. 8 is a cross-sectional view showing the construction of a main portion of a heating element formed in one portion of this end tip portion.

As shown in FIG. 7, a slanting face 31-3 is formed between a principal face 31-1 and an end face 31-2 of a substrate 31 formed in the shape of a flat plate by a material such as alumina, etc. This slanting face 31-3 has 0.2 to 1.0 mm in width t.

As shown in FIG. 8, a glass glaze layer 32 is formed on this slanting face 31-3 and has 5 to 50 $\mu$m in thickness. A heating resistor layer 33, an electrode layer 34 and a protecting layer 35 is laminated on this glass glaze layer 32. The heating resistor layer 33 is formed by Ta—$SiO_2$, etc., and the electrode layer 34 is formed by Al, etc., and the protecting layer 35 is formed by $Si_3N_4$, SiC, etc., by a vacuum thin film forming method typically represented by e.g., a sputtering method and a vacuum evaporation method. These layers constitute a heating element 36. For example, a circuit such as a drive IC (integrated circuit), etc. is mounted onto the principal face 31-1 and is connected to the electrode layer 34.

A paper sheet can be linearly conveyed in the direction of an arrow B in FIG. 8 while the paper sheet comes in contact with the glass glaze layer 32 of the heating element 36 of each of the thermal heads 1 to 4. Further, the distance from heating of the ink ribbon to separation of the ink ribbon from the recording medium can be shortened.

Figure 9:
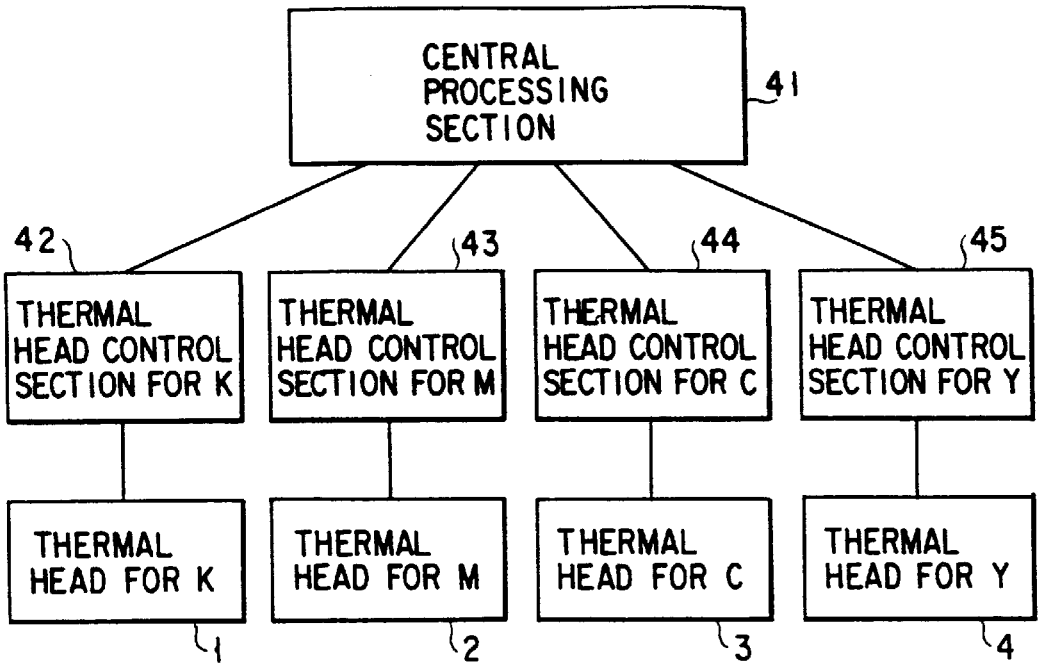
FIG. 9 is a block diagram showing the construction of a main portion circuit for controlling an operation of each of thermal leads of the color printer shown in FIG. 4.

FIG. 9 is a block diagram showing the construction of a main portion circuit controlling an operation of each of the thermal heads 1 to 4 in this color printer.

This color printer has a central processing section 41 constituting a control section. This central processing section 41 includes a CPU (central processing unit), a ROM (read only memory), a RAM (random access memory), etc. A thermal head control section 42 for K for controlling an operation of the thermal head 1 for K, a thermal head control section 43 for M for controlling an operation of the thermal head 2 for M, a thermal head control section 44 for C for controlling an operation of the thermal head 3 for C, and a thermal head control section 45 for Y for controlling an operation of the thermal head 4 for Y are connected to this central processing section 41.

Each of the thermal head control sections 42 to 45 controls a duty ratio, i.e., a pulse on/off ratio, of a drive pulse supplied to each of the thermal heads 1 to 4, or controls a voltage level for generating a drive electric current on the basis of a control signal output from the central processing section 41.

The thermal head control section 43 for M is operated at a stage after the thermal head for K. This thermal head control section 43 for M controls an ON pulse width (or a voltage level) of the drive pulse of the thermal head 2 for M such that this ON pulse width is equal to or greater than the ON pulse width (or voltage level) of a drive pulse supplied to the thermal head 1 for K by the thermal head control section 42 for K and is equal to or greater than an ON pulse width (or voltage level) at a level equal to or greater than an optimum lower limit level for the overlapping print.

The thermal head control section 44 for C and the thermal head control section 45 for Y control ON pulse widths (or voltage levels) of drive pulses of the corresponding thermal heads 3 and 4 such that these ON pulse widths are equal to or greater than pulse widths (or voltage levels) of the drive pulses of the thermal heads 2 and 3 at a previous stage.

In this embodiment form having such a construction, the respective thermal heads 1 to 4 are separated from each other with predetermined clearances from the platen rollers 6 to 9 in an unprinting state, e.g., just after a power source of the color printer is turned on, etc. The ink ribbon of each color is approximately at rest in a state in which the ink ribbon is tensioned with a predetermined tensile force.

A paper sheet 19 is then conveyed from the paper holder 18. When image printing timing in each of the thermal heads 1 to 4 is close at hand, each of the thermal heads 1 to 4 is lowered toward each of the platen rollers 6 to 9 so that the thermal heads, the ink ribbons, the paper sheet and the platen rollers attain a mutual press contact state.

Approximately at the same time as this press contact state, each ink ribbon is conveyed approximately at the same speed as the paper sheet 19 so that a printing preparation is completed. Thereafter, a heating resistor is heated on the basis of printing data so that the color printer attains a printing state.

First, a driving circuit of the thermal head 1 for K is operated by a printing data signal corresponding to black from a printing data source. Each heating element of the thermal head 1 for K is selectively heated in a printing condition suitably selected in the conventional thermal line printer.

All the heating elements of each thermal head can be simultaneously heated. The ink ribbon and the paper sheet are conveyed by 1/12 mm every 0.5 msec. The ink ribbon and the paper sheet 19 coming in contact with a selectively heating portion are separated from each other within 1 mm from a position heated by the thermal head so that ink is transferred onto the paper sheet 19.

At this time, since the distance between the thermal heads 1 to 4 is set to 100 mm, characters are overlapped and printed for a short time such as 600 msec.

A black image is first printed on the paper sheet 19 together with the conveyance of the paper sheet. In this print of the black image, the black image is directly printed on the paper sheet 19. Therefore, a preferable printing operation can be performed irrespective of a surface state of the paper sheet 19.

Subsequently, images of magenta, cyan and yellow are overlapped and printed. Namely, a driving circuit of the thermal head 2 for M is first operated by a printing data signal corresponding to magenta from the printing data source. Each heating element of this thermal head 2 for M is selectively heated with pulse period 0.5 msec, ON time 0.25 msec and energy 0.13 mJ/dot.

In this printing condition, energy is increased in comparison with the printing condition in the thermal head 1 for K in the above black print. This printing condition is set as a sufficient condition on the basis of an optimum condition in the thermal head 4 for Y. It is presumed that a preferable print can be realized even in a printing condition of slightly low energy in the thermal head 3 for C and the thermal head 2 for M.

After a magenta print is terminated, similar to the magenta print, a cyan image using cyan ink of the thermal head 3 for C is overlapped and printed on a magenta image formed on the paper sheet 19. Similarly, a yellow image is also overlapped and printed on the magenta and cyan images.

Figure 10:
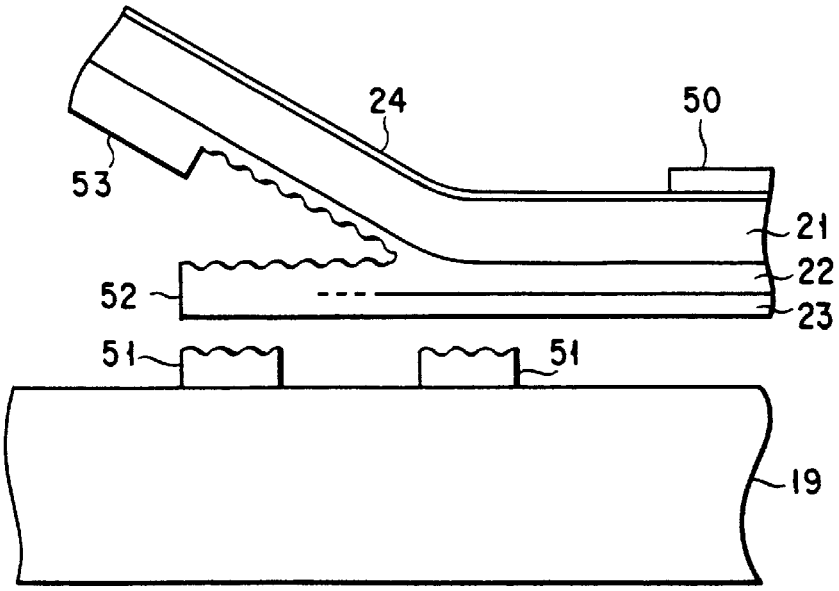
FIG. 10 is a view for explaining an ink separating state in an ink ribbon used in the color printer shown in FIG. 4.

FIG. 10 is a view for explaining an ink separating state in an ink ribbon and shows a state in which an image of a first color (black) is transferred onto the paper sheet 19 and an image of a second color (magenta) is then transferred to the paper sheet 19. Reference numeral 50 designates a heating element of the thermal head 2.

After ink of the first color is transferred to the paper sheet, the second color ink is transferred to the paper sheet for a very short time. Accordingly, no surface of the first color ink 51 transferred onto the paper sheet 19 is sufficiently solidified.

In a thermal transfer process, the transfer operation is reliably performed if a sum of force (a first force) required to separate melted ink 52 from the base film 21 and force (a second force) required to cut an area (dot) of the transferred melted ink 52 from an area (dot) 53 of untransferred ink is sufficiently smaller than adhesive force (a third force) between the melted ink 52 and the surface of the paper sheet 19 and ink 51 already transferred onto this paper sheet 19.

Accordingly, it is preferable to individually optimize the above three forces so as to stably perform the transfer operation.

With respect to the first force, the transfer operation is stabilized if the first force is weakened. When the transfer operation is performed on softened ink already transferred onto the paper sheet, the third force becomes weak in comparison with a case in which the transfer operation is directly performed on the surface of the paper sheet 19.

It is considered that the first or second force is set to be weaker than that in the case in which the transfer operation is directly performed on a sheet of recording paper so as to stably perform the transfer operation in the case in which the transfer operation is performed on this softened ink.

Energy given to the heating element is increased or ink having a low melting viscosity is used to reduce the first force.

Therefore, the printing operation is performed with 1.05 times, 1.1 times, 1.15 times and 1.2 times energy applied to the heating element of a thermal head printing the second color when the printing operation is directly performed on the paper sheet. In this case, transfer probability is improved and a preferable color record can be realized.

Further, a wax component constituting the separating layer 22 and a wax component included in the ink layer 23 are set to the same component or the same series so that these wax components are compatible at a heat melting time. If no materials of the separating layer 22 and the ink layer 23 are mutually compatible, the separating layer 22 and the ink layer 23 are separated from each other in the vicinity of an interface of both the layers within an ink ribbon. If these materials are compatible, a portion of these materials becomes compatible when these materials are melted by heat of the thermal head. Therefore, a layer portion having a lowest viscosity is separated.

Accordingly, the surface of ink transferred to the paper sheet 19 in this case is constructed by the composition of a large material ratio of the separating layer 22. If the second color ink is transferred onto such an ink surface, a surface of the first color ink, i.e., an upper face thereof and an adhesive face of the second color ink, i.e., a lower partial face thereof become compatible so that a stable overlapping printing operation can be performed. This effect is peculiar to a high speed print. It is effective to print the second color within 2 seconds from the first color print.

A line pressure applied to each of the thermal heads 1 to 4 will next be considered. Printing of characters is tested when the line pressure per unit length in a main scanning direction is 0.2, 0.3, 0.4, 0.5, 0.6, 0.7 and 0.8 kg/cm. In this case, the characters are preferably printed. When the line pressure is low, heat conduction efficiency from a heating element to a recording paper sheet is reduced so that required energy applied to each of the thermal heads is increased. In contrast to this, when the line pressure is increased, a thermal head protecting film is rapidly worn. Accordingly, in view of general reliability, the line pressure is more preferably set to 0.3 to 0.6 kg/cm. When a line pressure higher than 0.8 kg/cm is applied, a problem of shaving the base film of an ink ribbon is caused.

Here, evaluations of the melting viscosity of the above ink and an image quality of printed results thereof will be explained.

In these evaluations, a 4 inch width line type thermal head of 12 dot/mm in resolution is used and recording paper uses coat paper of about 1000 seconds in beck smoothness. In this case, the following two items are evaluated. The colors are printed in an order of magenta, cyan and yellow.

(1) Transfer probability: 50 image points each constructed by 8 dots×8 dots are recorded at a paper feed speed 6 inch/sec and are observed. Then, a percentage of the number of image points equal to or greater than 90% and equal to or smaller than 110% of the size of a normal image point with respect to the total observation number 50 is calculated. Transfer probability is set as follows with respect to this percentage.

When equal to or greater than 90% - - - AA

When equal to or greater than 80% and less than 90% - - - A

When equal to or greater than 70% and less than 80% - - - B

When less than 70% - - - C (2) Pattern edge sharpness characteristics: Bar patterns of a monochromatic color and colors of 80 mm×10 mm are arranged at predetermined intervals on a recording paper sheet, and are printed 5 times at a paper feed speed 6 inch/sec. Sharpness of a pattern edge is then observed and is subjectively evaluated at the four stages of AA, A, B and C. In this case, AA is set to show an excellent one, A an almost straight line, B a slightly faded one, and C is set to show a greatly faded one.

(Evaluation example 1)

Three kinds of yellow ink, magenta ink and cyan ink having different melting viscosities at 100° C. are respectively prepared. Abbreviations of M1, M2, M3, C1, C2, C3, Y1, Y2 and Y3 are added to respective ink ribbons.

Viscosities of the respective ink layers at 100° C. are given as follows in a range equal to or greater than $1\times10^4$ cps and equal to or smaller than $1\times10^7$ cps.

M1=C1=Y1=$2\times10^6$ cps

M2=C2=Y2=$1.2\times10^6$ cps

M3=C3=Y3=$8\times10^5$ cps

The separating layer has 5 cps in viscosity at 100° C. and is formed by a material having a melting point of 64.8° C. The base film layer and the back coat layer uses the same material.

FIGS. 11, 12 and 13 show the evaluation results of an image quality when the printing operation is performed by variously combining these inks M1, M2, M3, C1, C2, C3, Y1, Y2 and Y3 with each other. The printing operation is sequentially performed from inks located on a left-hand side and described in the item of ink in these figures.

As can be seen from these results, the transfer probability is stabler and the image quality is more preferable when the viscosity of ink overlapped later is lower, i.e., when a cps numeric value is smaller.

(Evaluation example 2)

The printing operation is performed by changing a ratio of the respective thicknesses of the compatible separating layers and ink layers, i.e., a condition of the separating layer/the ink layer (hereinafter, called a layer thickness ratio).

The separating layer has a melting point of 64.8° C. and has 5 cps in viscosity at 100° C. A magenta ink layer has a melting point of 80.0° C. and has $1.3\times10^6$ cps in viscosity at 100° C. A cyan ink layer has a melting point of 78.7° C. and has $8.5\times10^5$ cps in viscosity at 100° C. A yellow ink layer has a melting point of 77.5° C. and has $6.5\times10^5$ cps in viscosity at 100° C.

At a heat melting time, the separating layer and the ink layer become compatible so that the entire ink transferred onto the paper sheet approximately shows intermediate viscosity characteristics of the separating layer and the ink layer.

Accordingly, the layer thickness ratio exerts a great influence on a printing quality.

FIGS. 14 to 16 show evaluation results of the printing quality when each of the magenta, cyan and yellow inks is monochromatically printed.

FIG. 17 also shows evaluation results of the printing quality when inks of two colors are overlapped and printed. FIG. 18 further shows evaluation results of the printing quality when three colors of inks are overlapped and printed.

In the case of the monochromatic print, preferable results are approximately obtained in each of the colors. In contrast to this, in the case of the overlapping print, the difference between image qualities caused by the layer thickness ratio is large in comparison with the monochromatic print. Accordingly, it should be understood that transfer property is stable when the layer thickness ratio is high.

Similar results are obtained when the printing quality is evaluated in a sequential order of magenta, yellow and cyan, a sequential order of cyan, magenta and yellow, a sequential order of cyan, yellow and magenta, a sequential order of yellow, magenta and cyan, and a sequential order of yellow, cyan and magenta as color overlapping sequential orders except for the above color overlapping sequential order.

In the sequential order of magenta, cyan and yellow, the image quality is particularly stable in a condition in which melting point of magenta ink>melting point of cyan ink>melting point of yellow ink, and viscosity of magenta at 100° C.>viscosity of cyan at 100° C.>viscosity of yellow at 100° C. are satisfied.

Further, when yellow as a third color is particularly transferred in the color overlapping sequential order, the image quality is particularly excellent when the viscosity of the separating layer at 100° C. is equal to or smaller than $1\times10^3$ cps, and the melting point of the separating layer is 60 to 75° C., and the viscosity of the ink layer at 100° C. is equal to or greater than $1\times10^5$ cps and is equal to or smaller than $3\times10^6$ cps, and the melting point of the ink layer is 65 to 100° C., and the layer thickness ratio of the yellow ink ribbon is equal to or greater than 1.25.

The layer thickness ratio is preferably smaller than 3 and is more preferably smaller than 2.5 to secure a required density.

Further, a total layer thickness of both the separating layer and the ink layer is preferably equal to or smaller than 5 $\mu$m and is more preferably equal to or smaller than 3 $\mu$m in consideration of thermal efficiency in heating of a thermal line head with respect to the ink ribbon.

As mentioned above, in accordance with this embodiment form, ink is easily separated from the ink ribbon by reducing the melting viscosity of the ink of the ink ribbon overlapped and printed so that a permeating amount of the ink permeating a recessed portion of a recording paper sheet on its surface can be increased. As a result, a color image having a high quality can be printed at high speed without having any influence on a surface state of the recording paper sheet and a transfer state of the ink previously printed.

In this embodiment form, the overlapped and printed ink ribbon is constructed by the ink layer and the separating layer. The separating layer is not formed to simply separate the ink layer, but adjusts the melting viscosity of ink by setting the thickness of this separating layer to be thicker than that of the ink layer. Accordingly, the melting viscosity of ink can be simply adjusted to an optimum melting viscosity. The same effects can be also obtained in the case of a single layer in which the ink layer and the separating layer are mixed with each other in advance.

Further, it is possible to simply make a viscosity adjustment in which the ink viscosity is sequentially reduced by sequentially increasing energy applied to each of heating elements of the thermal heads 1 to 4 printing characters in a later sequential order in the overlapping print.

Further, the ink viscosity can be simply adjusted by adjusting the melting point of ink of an ink ribbon in accordance with the sequential order of the overlapping print.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A thermal transfer color printer for forming a color image directly on a printing medium, comprising:

conveying means for conveying the printing medium in a predetermined direction;

a first printing head for thermally transferring a coloring material of a first color component contained in a first ink ribbon onto the printing medium that is being conveyed in a predetermined direction by the conveying means, while heating the first ink ribbon and bringing the first ink ribbon into direct contact with the printing medium; and a second printing head for thermally transferring a coloring material of a second color component, different from the first color component, contained in a second ink ribbon onto the printing medium which has been conveyed through the first printing head by the conveying means, while heating the second ink ribbon and bringing the second ink ribbon into direct contact with the printing medium, wherein each of said first and second ink ribbons includes a base film, an intermediate layer which is formed of a first material having a viscosity less than $1\times10^4$ cps at 100° C. and disposed on the base film, and an ink layer which is formed of a second material containing the coloring material and having a viscosity in a range from $1\times10^4$ cps to $2\times10^8$ cps at 100° C. and disposed on the intermediate layer, and a melting viscosity of the intermediate layer and the ink layer of the second ink ribbon combined together is smaller than a melting viscosity of the intermediate layer and the ink layer of the first ink ribbon combined together.

2. A thermal transfer color printer according to claim 1, wherein said first and second materials are compatible with each other.

3. A thermal transfer color printer according to claim 2, wherein the intermediate layer and the ink layer of the second ink ribbon are thermally transferred onto the printing medium within two seconds after the intermediate layer and the ink layer of the first ink ribbon are thermally transferred.

4. A thermal transfer color printer according to claim 1, wherein a melting point of the first material is in a range from 60° C. to 90° C.

5. A thermal transfer color printer according to claim 1, wherein a melting point of the second material is 5° C. to 40° C. higher than a melting point of the first material.

6. A thermal transfer color printer according to claim 1, wherein the first and second materials have approximately the same density, in the vicinity of 1 g/cm$^3$.

7. A thermal transfer color printer according to claim 1, wherein the first and second printing heads are thermal heads.

8. A thermal transfer color printer according to claim 7, wherein the second printing head is subjected to 1.05 to 1.2 times more energy when the intermediate layer and the ink layer contained in the second ink ribbon are thermally transferred onto the printing medium than the first printing head is when the intermediate layer and the ink layer contained in the first ink ribbon are thermally transferred onto the printing medium.

9. A thermal transfer color printer according to claim 1, further comprising platen rollers each arranged at a position opposite one of the first and second printing heads and each having a rotation axis extending in a direction perpendicular to the direction of conveying of the printing medium, and wherein the first and second printing heads press the first and second ink ribbons, respectively, onto the corresponding one of the platen rollers with a line pressure in a range between 0.2 kg/cm and 0.8 kg/cm per unit length in the direction of conveying the printing medium.

10. A thermal transfer color printer according to claim 1, wherein each of the first and second color components is one of cyan, magenta and yellow.

11. A thermal transfer color printer according to claim 1, further comprising a third printing head for thermally, transferring a coloring material of a third color component, different from the first and second color components, contained in a third ink ribbon onto the printing medium which has been conveyed through the second printing head by the conveying means, while heating the third ink ribbon and bringing the third ink ribbon into direct contact with the printing medium, said third ink ribbon including a base film, an intermediate layer which is formed of the first material having the viscosity less than $1\times10^4$ cps at 100° C. and disposed on the base film, and an ink layer which is formed of the second material containing the coloring material and having the viscosity in the range from $1\times10^4$ cps to $2\times10^8$ cps at 100° C. and disposed on the intermediate layer, and wherein each of the first, second and third color components is one of cyan, magenta and yellow.

12. A thermal transfer color printer according to claim 11, wherein the first color component is magenta, the second color component is cyan, and the third color component is yellow.

13. A thermal transfer color printer according to claim 12, wherein the first, second and third ink ribbons have a relationship specified as:

a melting point of the intermediate layer and ink layer of the first ink ribbon combined together>a melting point of the intermediate layer and ink layer of the second ink ribbon combined together>a melting point of the intermediate layer and ink layers of the third ink ribbon combined together.

14. A thermal transfer color printer according to claim 12, wherein the first, second and third ink ribbons have a relationship specified as:

a viscosity at 100° C. of the intermediate layer and ink layer of the first ink ribbon combined together>a viscosity at 100° C. of the intermediate layer and ink layer of the second ink ribbon combined together> a viscosity at 100° C. of the intermediate layer and ink layer of the third ink ribbon combined together.

15. A thermal transfer color printer according to claim 12, wherein the third ink ribbon includes the intermediate layer which has a viscosity less than $1\times10^3$ cps at 100° C. and a melting point in a range from 65° C. to 75° C., and the ink layer which has a viscosity in a range from $1\times10^5$ cps to $3\times10^6$ cps at 100° C. and a melting point in a range from 65° C. to 100° C., and wherein a ratio of a thickness of the intermediate layer to a thickness of the ink layer is 1.25 or greater.

16. A thermal transfer color printer according to claim 1, wherein a total thickness of the intermediate layer and the ink layer is 5 $\mu$m or smaller.

17. A thermal transfer color printer according to claim 1, wherein a thickness of the base film is in a range from 1 $\mu$m to 15 $\mu$m.

18. A thermal transfer color printer according to claim 1, wherein the first and second ink ribbons have a relationship specified as:

a melting point of the intermediate layer and the ink layer of the first ink ribbon combined together>a melting point of the intermediate layer and the ink layer of the second ink ribbon combined together.

19. A thermal transfer color printer according to claim 1, wherein the first and second ink ribbons have a relationship specified as:

a viscosity at 100° C. of the intermediate layer and the ink layer of the first ink ribbon combined together>a viscosity at 100° C. of the intermediate layer and the ink layer of the second ink ribbon combined together.

20. A thermal transfer color printer for forming a color image directly on a printing medium, comprising:

conveying means for conveying the printing medium in a predetermined direction;

a first printing head for thermally transferring a coloring material of a first color component contained in a first ink ribbon onto the printing medium that is being conveyed in a predetermined direction by the conveying means, while heating the first ink ribbon and bringing the first ink ribbon into direct contact with the printing medium; and a second printing head for thermally transferring a coloring material of a second color component, different from the first color component, contained in a second ink ribbon onto the printing medium which has been conveyed through the first printing head by the conveying means, while heating the second ink ribbon and bringing the second ink ribbon into direct contact with the printing medium, wherein each of said first and second ink ribbons includes a base film, a mixed layer which is disposed on the base film and formed from a mixture of a first material having a viscosity less than $1\times10^4$ cps at 100 °C. and a second material containing the coloring material and having a viscosity in a range from $1\times10^4$ cps to $2\times10^8$ cps at 100° C., and a melting viscosity of the mixed layer of the second ink ribbon is smaller than a melting viscosity of the mixed layer of the first ink ribbon.

21. A thermal transfer color printer according to claim 20, wherein said first and second materials are compatible with each other.

22. A thermal transfer color printer according to claim 21, wherein the mixed layer of the second ink ribbon is thermally transferred onto the printing medium within two seconds after the mixed layer of the first ink ribbon is thermally transferred.

23. A thermal transfer color printer according to claim 20, wherein a melting point of the first material is in a range from 60° C. to 90° C.

24. A thermal transfer color printer according to claim 20, wherein a melting point of the second material is 5° C. to 40° C. higher than a melting point of the first material.

25. A thermal transfer color printer according to claim 20, wherein the first and second materials have approximately the same density, in the vicinity of 1 g/cm$^3$.

26. A thermal transfer color printer according to claim 20, wherein the first and second printing heads are thermal heads.

27. A thermal transfer color printer according to claim 26, wherein the second printing head is subjected to 1.05 to 1.2 times as much energy when the mixed layer contained in the second ink ribbon is thermally transferred onto the printing medium as the first printing head is when the mixed layer contained in the first ink ribbon is thermally transferred onto the printing medium.

28. A thermal transfer color printer according to claim 20, further comprising platen rollers each arranged at a position opposite one of the first and second printing heads and each having a rotation axis extending in a direction perpendicular to the direction of conveying the printing medium, and wherein the first and second printing heads press the first and second ink ribbons, respectively, onto the corresponding one of the platen rollers with a line pressure in a range between 0.2 kg/cm and 0.8 kg/cm per unit length in the direction of conveying of the printing medium.

29. A thermal transfer color printer according to claim 20, wherein each of the first and second color components is one of cyan, magenta and yellow.

30. A thermal transfer color printer according to claim 20, further comprising a third printing head for thermally transferring a coloring material of a third color component, different from the first and second color components, contained in a third ink ribbon onto the printing medium which has been conveyed through the second printing head by the conveying means, while heating the third ink ribbon and bringing the third ink ribbon into direct contact with the printing medium, said third ink ribbon including a base film, a mixed layer which is disposed on the base film and formed from the mixture of the first material having the viscosity less than $1\times10^4$ cps at 100° C. and the second material containing the coloring material and having the viscosity in the range from $1\times10^4$ cps to $2\times10^8$ cps at 100° C., and wherein each of the first, second, and third color components is one of cyan, magenta and yellow.

31. A thermal transfer color printer according to claim 30, wherein the first color component is magenta, the second color component is cyan, and the third color component is yellow.

32. A thermal transfer color printer according to claim 31, wherein the first, second and third ink ribbons have a relationship specified as:

a melting point of the mixed layer of the first ink ribbon>a melting point of the mixed layer of the second ink ribbon>a melting point of the mixed layer of the third ink ribbon.

33. A thermal transfer color printer according to claim 31, wherein the first, second and third ink ribbons have a relationship specified as:

a viscosity at 100° C. of the mixed layer of the first ink ribbon>a viscosity at 100° C. of the mixed layer of the second ink ribbon>a viscosity at 100° C. of the mixed layer of the third ink ribbon.

34. A thermal transfer color printer according to claim 20, wherein a thickness of the mixed layer is 5 $\mu$m or smaller.

35. A thermal transfer color printer according to claim 20, wherein a thickness of the base film is in a range from 1 $\mu$m to 15 $\mu$m.

36. A thermal transfer color printer according to claim 20, wherein the first and second ink ribbons have a relationship specified as:

a melting point of the mixed layer of the first ink ribbon>a melting point of the mixed layer of the second ink ribbon.

37. A thermal transfer color printer according to claim 20, wherein the first and second ink ribbons have a relationship specified as:

a viscosity at 100° C. of the mixed layer of the first ink ribbon>a viscosity at 100° C. of the mixed layer of the second ink ribbon.

38. An ink ribbon unit for being used in a thermal transfer color printer which forms a color image directly on a printing medium, said unit comprising:

a first ink ribbon containing a coloring material of a first color component which is thermally transferred by means of a first printing head of the color printer onto the printing medium that is being conveyed in a predetermined direction, while the first ink ribbon is heated and brought in to direct contact with the printing medium; and a second ink ribbon containing a coloring material of a second color component different from the first color component, which is thermally transferred by means of a second printing head of the color printer onto the printing medium which has passed the first printing head, while the second ink ribbon is heated and brought into direct contact with the printing medium, and wherein:

each of said first and second ink ribbons includes a base film, an intermediate layer which is formed of a first material having a viscosity less than $1\times10^4$ cps at 100° C. and disposed on the base film, and an ink layer which is formed of a second material containing the coloring material and having a viscosity in a range from $1\times10^4$ cps to $2\times10^8$ cps at 100° C. and disposed on the intermediate layer, and a melting viscosity of the intermediate layer and the ink layer of the second ink ribbon combined together is smaller than a melting viscosity of the intermediate layer and the ink layer of the first ink ribbon combined together.

39. An ink ribbon unit, according to claim 38, wherein said first and second materials are compatible with each other.

40. An ink ribbon unit according to claim 39, wherein the intermediate layer and the ink layer of the second ink ribbon are thermally transferred onto the printing medium within two seconds after the intermediate layer and the ink layer of the first ink ribbon are thermally transferred.

41. An ink ribbon unit according to claim 38, wherein a melting point of the first material is in a range from 60° C. to 90° C.

42. An ink ribbon unit according to claim 38, wherein a melting point of the second material is 5° C. to 40° C. higher than a melting point of the first material.

43. An ink ribbon unit according to claim 38, wherein the first and second materials have approximately the same density, in the vicinity of 1 g/cm$^3$.

44. An ink ribbon unit according to claim 38, wherein each of the first and second color components is one of cyan, magenta and yellow.

45. An ink ribbon unit according to claim 38, further comprising a third ink ribbon containing a coloring material of a third color component different from the first and second color components, which is thermally transferred by means of a third printing head of the color printer onto the printing medium which has passed the second printing head, while the third ink ribbon is heated and brought into direct contact with the printing medium, said third ink ribbon including a base film, an intermediate layer which is formed of the first material having the viscosity less than $1\times10^4$ cps at 100° C. and disposed on the base film, and an ink layer which is formed of the second material containing the coloring material and having the viscosity in the range from $1\times10^4$ cps to $2\times10^8$ cps at 100° C. and disposed on the intermediate layer, and wherein each of the first, second and third color components is one of cyan, magenta and yellow.

46. An ink ribbon unit according to claim 45, wherein the first color component is magenta, the second color component is cyan, and the third color component is yellow.

47. An ink ribbon unit according to claim 46, wherein the first, second and third ink ribbons have a relationship specified as:

a melting point of the intermediate layer and ink layer of the first ink ribbon combined together>a melting point of the intermediate layer and ink layer of the second ink ribbon combined together>a melting point of the intermediate layer and ink layer of the third ink ribbon combined together.

48. An ink ribbon unit according to claim 46, wherein the first, second and third ink ribbons have a relationship specified as:

a viscosity at 100° C. of the intermediate layer and ink layer of the first ink ribbon combined together>a viscosity at 100° C. of the intermediate layer and ink layer of the second ink ribbon combined together>a viscosity at 100° C. of the intermediate layer and ink layer of the third ink ribbon combined together.

49. An ink ribbon unit according to claim 46, wherein the third ink ribbon includes the intermediate layer which has a viscosity less than $1\times10^3$ cps at 100° C. and a melting point in a range from 65° C. to 75° C., and the ink layer which has a viscosity in a range from $1\times10^5$ cps to $3\times10^6$ cps at 100° C. and a melting point in a range from 65° C. to 100° C., and wherein a ratio of a thickness of the intermediate layer to a thickness of the ink layer is 1.25 or greater.

50. An ink ribbon unit according to claim 38, wherein a total thickness of the intermediate layer and the ink layer is 5 $\mu$m or smaller.

51. An ink ribbon unit according to claim 38, wherein a thickness of the base film is in a range from 1 $\mu$m to 15 $\mu$m.

52. An ink ribbon unit according to claim 38, wherein the first and second ink ribbons have a relationship specified as:

a melting point of the intermediate layer and the ink layer of the first ink ribbon combined together>a melting point of the intermediate layer and the ink layer of the second ink ribbon combined together.

53. An ink ribbon unit according to claim 38, wherein the first and second ink ribbons have a relationship specified as:

a viscosity at 100° C. of the intermediate layer and the ink layer of the first ink ribbon combined together>a viscosity at 100° C. of the intermediate layer and the ink layer of the second ink ribbon combined together.

54. An ink ribbon unit for being used in a thermal transfer color printer which forms a color image directly on a printing medium, said unit comprising:

a first ink ribbon containing a coloring material of a first color component which is thermally transferred by a first printing head of the color printer onto the printing medium that is being conveyed in a predetermined direction, while the first ink ribbon is heated and brought into direct contact with the printing medium; and a second ink ribbon containing a coloring material of a second color component different from the first color component, which is thermally transferred by a second printing head of the color printer onto the printing medium which has passed the first printing head, while the second ink ribbon is heated and brought into direct contact with the printing medium, and wherein:

each of said first and second ink ribbons includes a base film, a mixed layer which is disposed on the base film and formed from a mixture of a first material having a viscosity less than $1\times10^4$ cps at 100° C. and a second material containing the coloring material and having a viscosity in a range from $1\times10^4$ cps to $2\times10^8$ cps at 100° C., and a melting viscosity of the mixed layer of the second ink ribbon is smaller than a melting viscosity of the mixed layer of the first ink ribbon.

55. An ink ribbon unit according to claim 54, wherein said first and second materials are compatible with each other.

56. An ink ribbon unit according to claim 55, wherein the mixed layer of the second ink ribbon is thermally transferred onto the printing medium within two seconds after the mixed layer of the first ink ribbon is thermally transferred.

57. An ink ribbon unit according to claim 54, wherein a melting point of the first material is in a range from 60° C. to 90° C.

58. An ink ribbon unit according to claim 54, wherein a melting point of the second material is 5° C. to 40° C. higher than a melting point of the first material.

59. An ink ribbon unit according to claim 54, wherein the first and second materials have approximately the same density, in the vicinity of 1 g/cm$^3$.

60. An ink ribbon unit according to claim 54, wherein each of the first and second color components is one of cyan, magenta and yellow.

61. An ink ribbon unit according to claim 54, further comprising a third ink ribbon containing a coloring material of a third color component different from the first and second color components, which is thermally transferred by means of a third printing head of the color printer onto the printing medium which has passed the second printing head, while the third ink ribbon is heated and brought into direct contact with the printing medium, said third ink ribbon including a base film, a mixed layer which is disposed on the base film and formed from the mixture of the first material having the viscosity less than $1\times10^4$ cps at 100° C. and the second material containing the coloring material and having the viscosity in the range from $1\times10^4$ cps to $2\times10^8$ cps at 100° C., and wherein each of the first, second and third color components is one of cyan, magenta and yellow.

62. An ink ribbon unit according to claim 61, wherein the first color component is magenta, the second color component is cyan, and the third color component is yellow.

63. An ink ribbon unit according to claim 62, wherein the first, second and third ink ribbons have a relationship specified as:

a melting point of the mixed layer of the first ink ribbon>a melting point of the mixed layer of the second ink ribbon>a melting point of the mixed layer of the third ink ribbon.

64. An ink ribbon unit according to claim 62, wherein the first, second and third ink ribbons have a relationship specified as:

the viscosity of the mixed layer of the first ink ribbon at 100° C.>the viscosity of the mixed layer of the second ink ribbon at 100° C.>a viscosity of the mixed layer of the third ink ribbon at 100° C.

65. An ink ribbon unit according to claim 54, wherein a thickness of the mixed layer is 5 $\mu$m or smaller.

66. An ink ribbon unit according to claim 54, wherein a thickness of the base film is in a range from 1 $\mu$m to 15 $\mu$m.

67. An ink ribbon unit according to claim 54, wherein the first and second ink ribbons have a relationship specified as:

a melting point of the mixed layer of the first ink ribbon>a melting point of the mixed layer of the second ink ribbon.

68. An ink ribbon unit according to claim 54, wherein the first and second ink ribbons have a relationship specified as:

a viscosity of the mixed layer of the first ink ribbon at 100° C.>a viscosity of the mixed layer of the second ink ribbon at 100° C.

* * * * *